US007234522B2

(12) United States Patent
Johnson et al.

(10) Patent No.: US 7,234,522 B2
(45) Date of Patent: Jun. 26, 2007

(54) APPARATUS AND METHOD FOR DRILLING A WELLBORE WITH CASING AND CEMENTING THE CASING IN THE WELLBORE

(75) Inventors: Michael R. Johnson, Maurice, LA (US); John Touchet, Houston, TX (US); Scott Myers, Houston, TX (US); Robert W. Srubar, Katy, TX (US)

(73) Assignee: Halliburton Energy Services, Inc., Duncan, OK (US)

( * ) Notice: Subject to any disclaimer, the term of this patent is extended or adjusted under 35 U.S.C. 154(b) by 526 days.

(21) Appl. No.: 10/323,426

(22) Filed: Dec. 18, 2002

(65) Prior Publication Data

US 2004/0118560 A1 Jun. 24, 2004

(51) Int. Cl.
*E21B 33/13* (2006.01)

(52) U.S. Cl. ..... 166/285; 166/291; 166/327; 166/242.8; 166/153; 166/124

(58) Field of Classification Search ..... 175/171; 166/285, 291, 325–327, 319, 242.8, 153, 166/123, 124, 66.7
See application file for complete search history.

(56) References Cited

U.S. PATENT DOCUMENTS

| | | | | |
|---|---|---|---|---|
| 2,058,688 | A | 10/1936 | Halliburton | 166/318 |
| 2,117,318 | A | 5/1938 | Hanes | 116/325 |
| 2,204,340 | A | 6/1940 | Bradshaw | 166/193 |
| 2,352,744 | A | 7/1944 | Stoddard | 166/154 |
| 2,846,015 | A | 8/1958 | Pittman | 166/320 |
| 2,847,074 | A | 8/1958 | Maly et al. | 166/325 |
| 3,120,269 | A | 2/1964 | Evans et al. | 166/120 |
| 3,332,499 | A | 7/1967 | Harris et al. | 166/242.8 |
| 3,385,370 | A | 5/1968 | Knox et al. | 166/317 |
| 3,385,372 | A | 5/1968 | Knox | 166/325 |
| 3,409,078 | A | 11/1968 | Knox et al. | 166/374 |
| 3,730,267 | A | 5/1973 | Scott | 166/335 |
| 3,768,562 | A | 10/1973 | Baker | 166/289 |
| 3,776,250 | A | 12/1973 | Knox | 137/71 |
| 3,948,322 | A | 4/1976 | Baker | 166/289 |
| 4,151,875 | A | 5/1979 | Sullaway | 166/126 |

(Continued)

OTHER PUBLICATIONS

Halliburton Casing Sales Manual, Oct. 8, 1993, pp. 1-13 and 1-23.

(Continued)

*Primary Examiner*—David Bagnell
*Assistant Examiner*—Matthew J. Smith
(74) *Attorney, Agent, or Firm*—John W. Wustenberg; McAfee & Taft

(57) ABSTRACT

A float system for use in cementing a casing in a wellbore. The wellbore is drilled with a drill bit attached to the casing. The drill bit is removed after the wellbore is drilled. The float system is lowered into the casing after the drill bit is removed. The float system includes a packer apparatus with a float apparatus, preferably a float shoe, attached to the end thereof. The packer apparatus is set in the casing to hold the float shoe in position. A bottom cementing plug is placed in the casing and is urged downwardly until it engages the upper end of the packer apparatus. The cement will flow through the packer apparatus and the float apparatus to fill the annulus between the casing and the wellbore.

20 Claims, 3 Drawing Sheets

U.S. PATENT DOCUMENTS

| | | | | |
|---|---|---|---|---|
| 4,250,966 | A | 2/1981 | Streich et al. | 166/242.8 |
| 4,338,999 | A | 7/1982 | Carter, Jr. | 166/117 |
| 4,413,682 | A | 11/1983 | Callihan et al. | 166/242.8 |
| 4,457,377 | A | 7/1984 | Burris, II | 166/332.4 |
| 4,712,619 | A | 12/1987 | Stepp et al. | 166/327 |
| 4,729,432 | A | 3/1988 | Helms | 166/317 |
| 5,025,858 | A * | 6/1991 | Glaser | 166/153 |
| 5,224,540 | A | 7/1993 | Streich et al. | 166/118 |
| 5,271,468 | A | 12/1993 | Streich et al. | 166/387 |
| 5,379,835 | A | 1/1995 | Streich | 166/181 |
| 5,390,737 | A | 2/1995 | Jacobi et al. | 166/184 |
| 5,472,053 | A | 12/1995 | Sullaway et al. | 166/327 |
| 5,494,107 | A | 2/1996 | Bode | 116/285 |
| 5,540,279 | A | 7/1996 | Branch et al. | 116/118 |
| 5,647,434 | A | 7/1997 | Sullaway et al. | 166/242.8 |
| 5,701,959 | A | 12/1997 | Hushbeck et al. | 166/387 |
| 5,890,538 | A | 4/1999 | Beirute et al. | 166/285 |
| 5,984,029 | A * | 11/1999 | Griffin et al. | 166/242.7 |
| 6,102,117 | A | 8/2000 | Swor et al. | 166/138 |
| 6,167,963 | B1 | 1/2001 | McMahan et al. | 166/179 |
| 6,244,342 | B1 | 6/2001 | Sullaway et al. | 166/285 |
| 6,263,987 | B1 * | 7/2001 | Vail, III | 166/285 |
| 6,397,946 | B1 * | 6/2002 | Vail, III | 166/66.7 |
| 6,497,291 | B1 * | 12/2002 | Szarka | 166/227 |
| 6,722,451 | B2 * | 4/2004 | Saugier | 175/171 |

OTHER PUBLICATIONS

Halliburton Services, "Floating Equipment" catalog (undated but admitted to be prior art).

SPE Paper 25440 entitled "Reverse Circulation Of Cement On Primary Jobs Increase Cement Column Height Across Weak Formation" by J. E. Griffith, D. Q. Nix and G. A. Boe, presented at the Production Operation Symposium held in Oklahoma City, Oklahoma, Mar. 21-23, 1993.

Journal of Petroleum Technology article titled "Primary Cementing By Reverse Circulation Solves Critical Problem In The North Hassi-Messaoud Field, Algeria" by R. Marquaire and J. Brisac, Feb. 1966, pp. 146-150.

Purchase Order No. 4501374200 issued Jun. 11, 2001.

Purchase Order No. 4501380766 issued Jun. 14, 2001.

Halliburton Services Sales & Service Catalog No. 43, pp. 2561-2562 and 2556-2557 (1985).

Halliburton Catalog Page titled EZ DRILL® Squeeze Packer (undated but admitted to be prior art).

* cited by examiner

APPARATUS AND METHOD FOR DRILLING A WELLBORE WITH CASING AND CEMENTING THE CASING IN THE WELLBORE

BACKGROUND OF THE INVENTION

This invention relates generally to methods and apparatus for cementing a casing in a wellbore, and more specifically is directed to methods and apparatus for utilizing float equipment inside casing used to drill a wellbore.

There are a variety of known methods for drilling wellbores to intersect with one or more hydrocarbon-producing formations for the production of oil and/or gas. One known procedure, and an increasingly common procedure for drilling a wellbore utilizes the casing string that will be cemented into the wellbore as the drill string. When a wellbore is drilled utilizing casing as the drill string, the wellbore is drilled to a desired depth, and the casing is typically pulled upwardly a distance from the bottom of the drilled wellbore. The drill bit on the lower end of the casing is then blown off using an explosive charge on a wireline, or is disconnected from the casing by other means known in the art.

Once the drill bit has been removed from the lower end of the casing, mud or other circulating fluids may be circulated through the casing. A bottom cementing plug can then be displaced into the casing ahead of the cement. The bottom cementing plug is allowed to pass through the open lower end of the casing and cement passes around the lower end of the casing upwardly into the annulus between the casing and the wellbore. Once the desired amount of cement has been displaced into the casing, a top cementing plug is placed in the casing behind the trailing edge of the cement. The top plug and the cement therebelow are urged downwardly in the casing by drilling mud or other known displacement fluids. Once the desired amount of cement has been placed in the annulus between the casing and the wellbore to cement the casing in the wellbore, which may occur either before or after the top cementing plug exits the casing, flow of the displacement fluid is stopped. Pressure is maintained utilizing a valve system at the surface, typically in connection with a plug container. Prior to conducting any further operations or procedures, it is generally necessary to wait several hours to insure that the cement is adequately set up prior to removing surface equipment, such as the plug container, and then reassembling the wellhead. Although such procedures exist for drilling with casing and then cementing the casing in a wellbore, the time loss is significant and costly. Thus, an improved apparatus and method for drilling with casing and cementing casing in a wellbore is needed.

SUMMARY OF THE INVENTION

The present invention provides an improved method and apparatus for cementing casing in a wellbore. The apparatus includes a casing with a drill bit attached to the lower end thereof. The wellbore is drilled with the casing as the drill string. Once the wellbore is drilled, the casing is pulled upwardly to lift the drill bit from the bottom of the wellbore. The drill bit is then disconnected from the casing by any manner known in the art.

The apparatus further includes a check valve placed in the casing after the drill bit is disconnected from the casing. The check valve is preferably a part of a float apparatus and more preferably is part of float shoe which includes an outer case with the check valve connected therein. The check valve includes a valve body connected in the outer case. The valve body defines a valve seat. The check valve also includes a valve poppet which includes a valve element that is engageable with the valve seat.

The float shoe is connected to a packer apparatus which is lowered into the casing to a desired location in the casing. The packer apparatus can be lowered into the casing on a wireline or by other means known in the art. Once the packer apparatus is lowered into the casing, it is set in the casing so that it will hold the packer apparatus and the float shoe in the casing. The wireline is then removed and cementing operations can begin. A bottom cementing plug may be placed in the casing ahead of the leading edge of the cement. The bottom cementing plug will land on the upper end of the packer apparatus and a rupturable diaphragm will burst allowing cement to flow through the bottom cementing plug, the packer apparatus and the float apparatus. Cement will be displaced into the annulus between the casing and the wellbore. Once a sufficient amount of cement has been placed in the casing, a top cementing plug may be placed in the casing behind the trailing edge of the cement and will be urged downwardly with a displacement fluid. The top cementing plug will land on the bottom cementing plug. Reassembly of the wellhead at the surface can begin since the float apparatus will prevent the back flow of cement into the casing.

BRIEF DESCRIPTION OF THE DRAWINGS

FIG. 2, comprising

FIG. 3, comprising

DETAILED DESCRIPTION OF A PREFERRED EMBODIMENT

Figure 1:
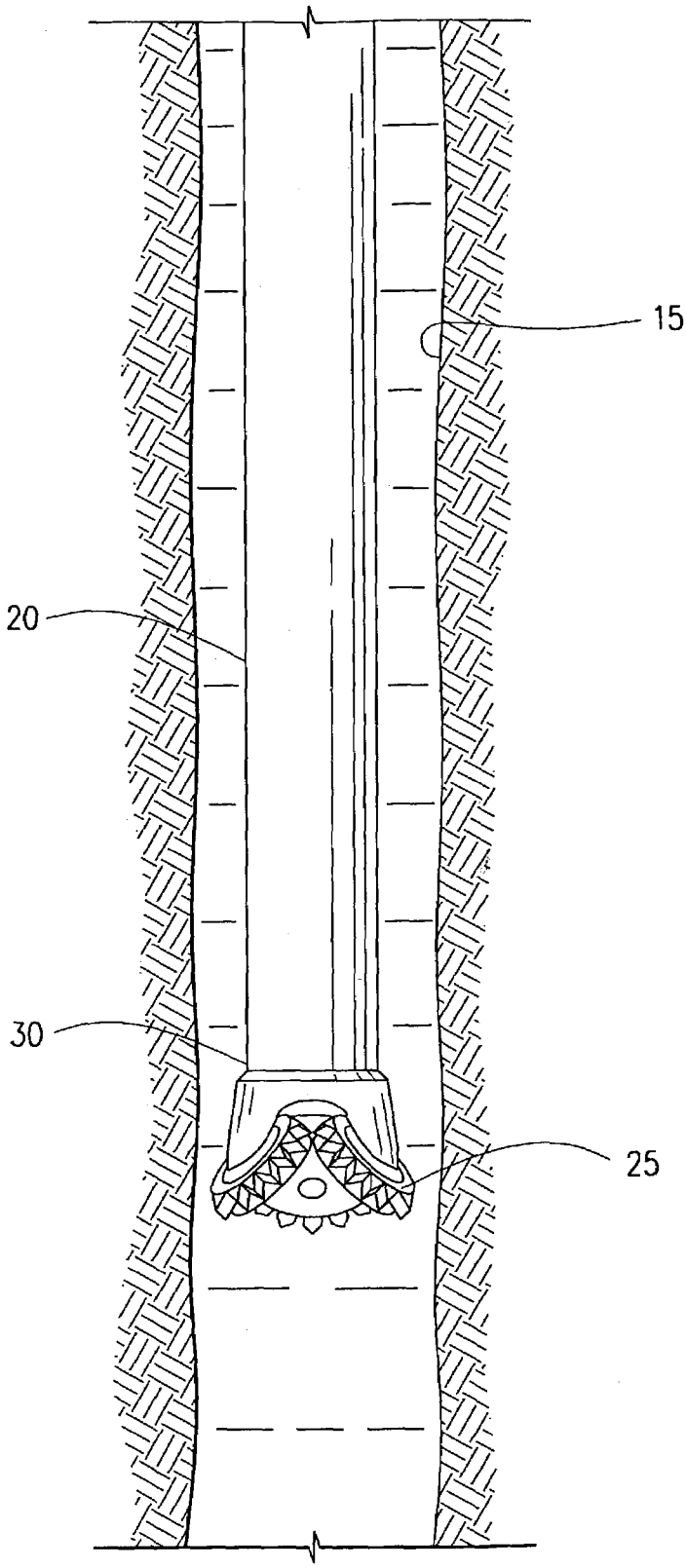
FIG. 1 schematically shows a casing with a drill bit on the lower end thereof drilling a wellbore.
Figures 2A, 2B:
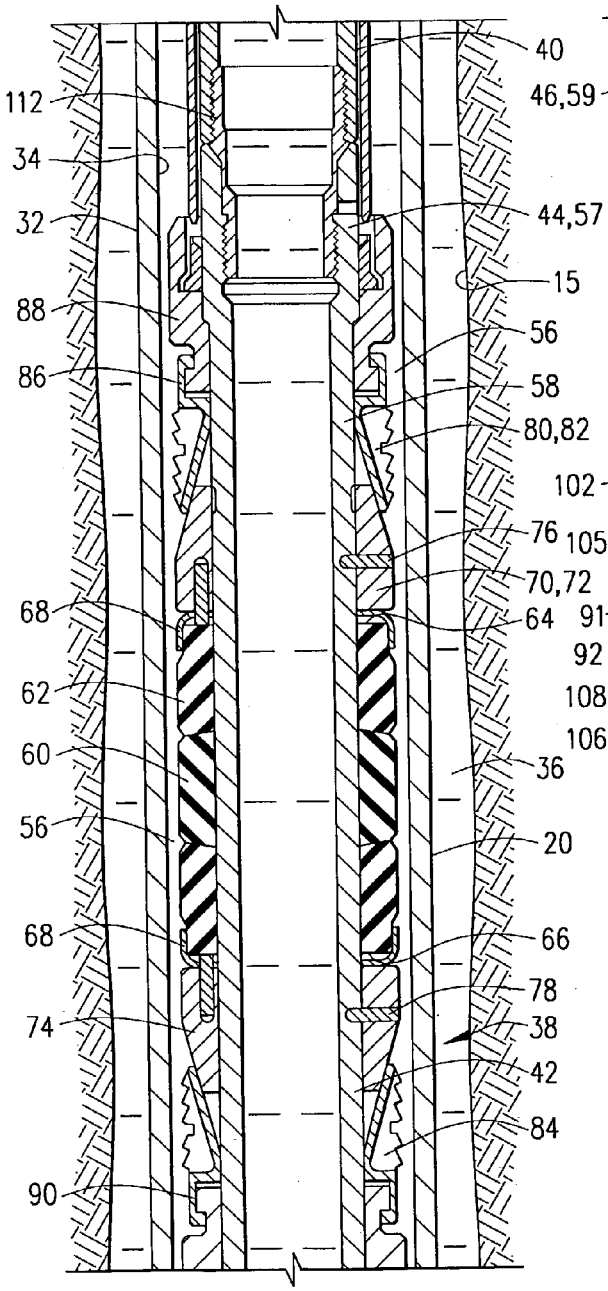
FIGS. 2A and 2B, shows a float system of the present invention lowered into the casing.

Referring now to the drawings and more particularly to FIG. 1, a wellbore 15 is shown with a casing 20 disposed therein. Casing 20 has a drill bit 25 connected to a lower end 30 thereof by any conventional means known in the art. Wellbore 15 is being drilled by drill bit 25 which is attached to casing 20. Casing 20 has an outer surface 32 and an inner surface 34 as shown in FIG. 2. An annulus 36 is defined between outer surface 32 and wellbore 15.

The apparatus 38 of the present invention, which may be also referred to as a float system 38, is shown in FIG. 2 lowered into wellbore 15. The apparatus 38 can be lowered into casing 20 on wireline using a wireline setting device 40. Wireline setting device 40 may be of any type known in the art. Apparatus 38 can be lowered on a wireline or any other method known in the art. Apparatus 38 includes a packer apparatus or packer assembly 42 having an upper end 44 and a lower end 46. Apparatus 38 further includes a float apparatus 48 connected to packer assembly 42. In the embodiment shown, float apparatus 48 is a float shoe, but may be other float apparatus. A coupling 50 is connected at threaded connection 52 to lower end 46 of packer apparatus 42 and is connected at threaded connection 54 to float apparatus 48.

Figure 3A:
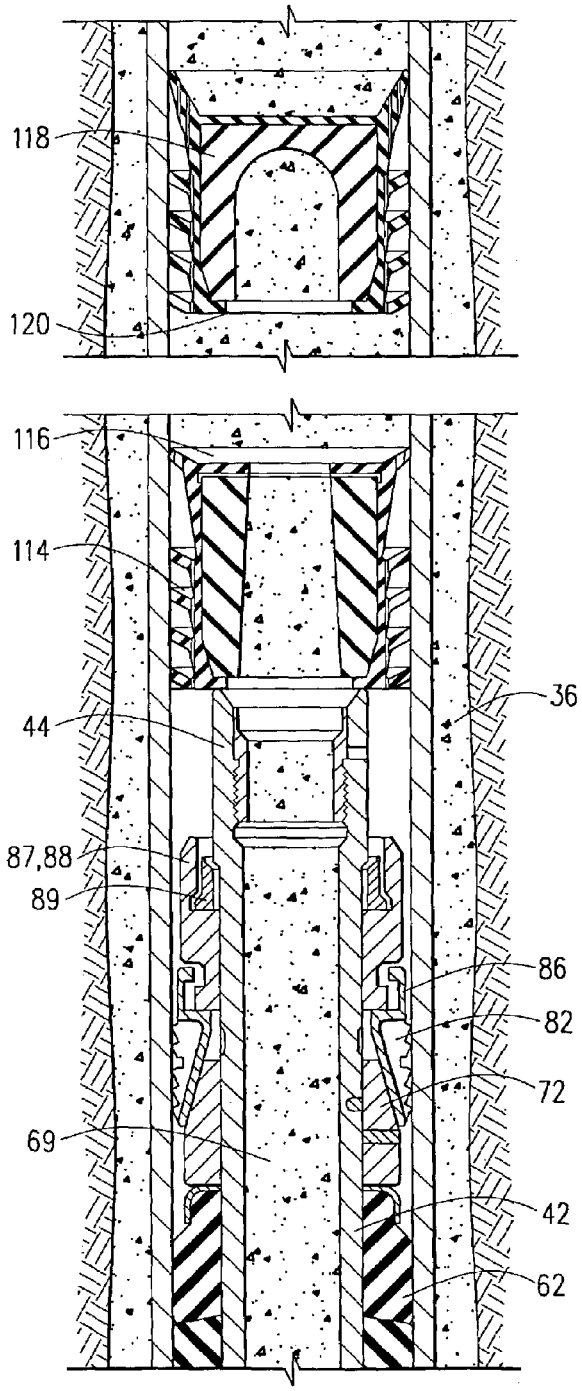
FIGS. 3A and 3B, shows the float system of the present invention engaging the casing in the wellbore during cementing operations.
Figure 3B:
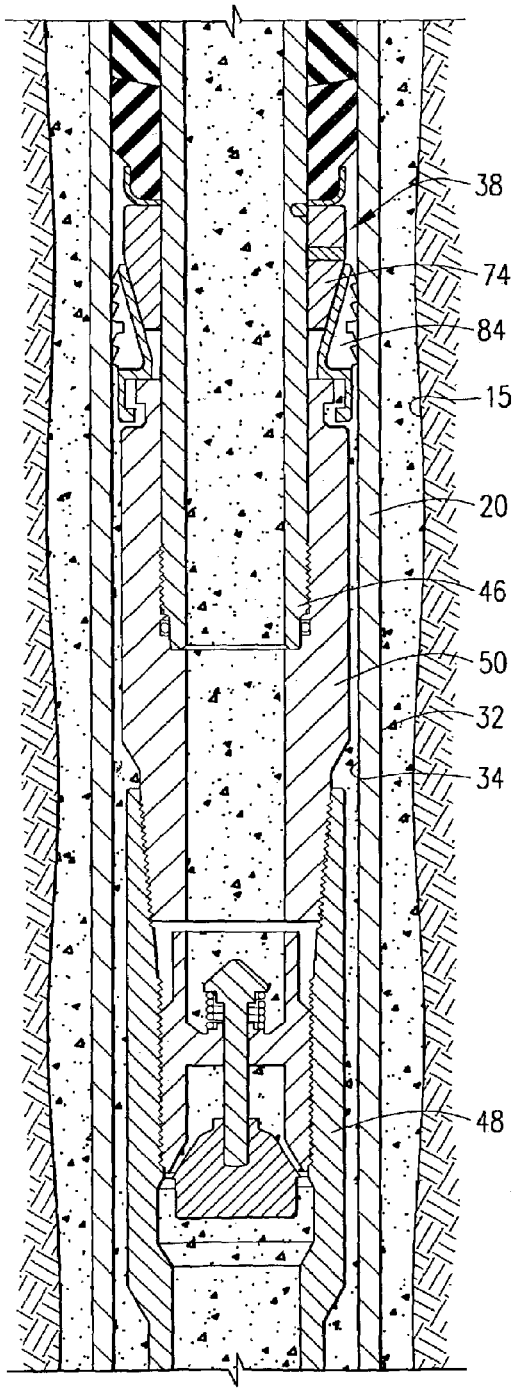

In FIG. 2, packer apparatus 42 is shown in an unset position so that a space or annulus 56 is defined between packer apparatus 42 and inner surface 34 of casing 20. FIG. 3 shows packer assembly 42 in a set position wherein the packer assembly 42 is engaged with casing 20 to hold apparatus 38, and more specifically packer apparatus 42 and float apparatus 48 in casing 20. Packer apparatus 42 includes a packer mandrel 58 with upper end 57 and lower end 59. A packer element assembly 60 is disposed about packer mandrel 58. Packer element assembly 60 may include one or more packer elements 62 and in the embodiment shown has three packer elements 62. Packer element assembly 60 has an upper end 64 and a lower end 66. As shown in FIG. 3, when packer apparatus 42 is in its set position, packer element assembly 60 sealingly engages casing 20 sufficiently to hold packer apparatus 42 and float apparatus 48 in place in casing 20. Packer apparatus 42 has packer retaining shoe or retaining ring 68 at the upper and lower ends 64 and 66 of packer element assembly 60 for axially retaining packer element assembly 60. Packer mandrel 58 defines a bore 69 which is preferably an uninterrupted bore and has no obstructions from upper end 57 to lower end 59 thereof.

Packer apparatus 42 includes slip wedges 70 which may be referred to as upper slip wedge 72 and lower slip wedge 74. Upper slip wedge 72 is positioned adjacent retaining ring 68 at the upper end 64 of packer element assembly 60. In similar fashion, lower slip wedge 74 is positioned adjacent retaining ring 68 at the lower end 66 of packer element assembly 60. Upper slip wedge 72 is attached to packer mandrel 58 with a shear pin 76. Lower slip wedge 74 is attached to packer mandrel 58 with a shear pin 78.

Packer apparatus 42 likewise includes slip segments 80 which may be referred to as upper lip segments 82 and lower slip segments 84. Upper slip segments 82 are connected with an upper retainer portion 86 thereof to a setting ring assembly 88 which may be referred to as a lock ring assembly 88. Lock ring assembly 88 includes a lock ring housing 87 and a lock ring 89. Lower slip segments 84 are connected with a lower retainer portion 90 thereof to coupling 50 which as set forth herein is threadedly connected to packer mandrel 58.

Float shoe 48 is connected to lower end 59 of packer mandrel 58 with coupling 50, which is preferably a steel coupling 50. Float shoe 48 includes an outer case or outer sleeve 91. A check valve 92 is connected in outer case 91 and in the embodiment shown is threadedly connected therein. Check valve 92 includes a valve body 94 and a valve poppet 96. Valve poppet 96 includes a valve stem 98 having a head portion 100 defined at the upper end 102 thereof. A valve element 104 is connected to a lower end 106 of valve stem 98 and is preferably threadedly connected to valve stem 98. Valve stem 98 is disposed in a valve guide 105 which extends inwardly from and may be integrally formed or connected with valve body 94. A spring 107 is positioned between valve guide 105 and head portion 100 and urges valve stem 98, and thus valve element 104, upwardly into engagement with a valve seat 108 defined on valve body 94. An elastomeric seal, which may be referred to as a lip seal 110 may be affixed to the valve element 104 to provide sealing engagement between valve element 104 and valve seat 108.

The operation of apparatus 38 is apparent from the drawings. As shown in FIG. 1, a wellbore 15 is drilled utilizing drill bit 25 on casing 20. Wellbore 15 may be drilled by any known method utilizing casing 20 to drill wellbore 15. Once wellbore 15 is drilled to a desired depth, casing 20 is pulled to move drill bit 25 upwardly from the bottom of the well. Once casing 20 has been pulled upwardly a desired amount, drill bit 25 is removed or disconnected from lower end 30 of casing 20, and allowed to fall to the bottom of wellbore 15. Drill bit 25 may be disconnected from casing 20 by any means known in the art, such as by utilizing an explosive charge lowered into the casing 20 on a wireline or by any other method known in the art. Once drill bit 25 has been disconnected from the casing 20, float system 38 is lowered into the casing 20 with a wireline or by any other means known in the art. In the embodiment shown, a wireline setting device 40 is shown connected to a tension sleeve 112 which is in turn threadedly connected to upper end 44 of packer apparatus 42 so that the packer apparatus 42 may be lowered into casing 20 on a wireline.

Once apparatus 38 has been lowered into casing 15, packer apparatus 42 is set using wireline setting device 40 by any manner known in the art, and thus is moved into the position shown in FIG. 3. As is known in the art, the wireline setting device 40 will urge setting ring assembly 88 downwardly which will cause upper slip segments 82 to engage casing 20. Packer mandrel 58 can then be pulled upwardly with wireline setting device 40. Coupling 50 will cause upper slip segments 82 to move upwardly. Upward force will continue to be applied so that shear pins 78 and 76 break and packer element assembly 60 is forced outwardly to engage casing 20. Packer element assembly 60 will sealingly engage casing 20 and will support packer apparatus 42 and float apparatus 48 in casing 20. Continued application of upward force to wireline setting device 40 will cause tension sleeve 112 to break so that wireline setting device 40 may be removed from casing 20.

As shown in FIG. 3, once float system 38 has been placed in casing 20 and packer apparatus 42 has been set to engage and hold float system 38 therein, fluid may be displaced therethrough to condition wellbore 15 for cementing. Once any such operations have been completed, a bottom cementing plug 114 of a type known in the art may be placed in casing 20 ahead of a leading edge 116 of the cement in casing 20. As is known in the art, bottom cementing plug 114 will initially have a rupturable diaphragm across an upper end thereof. When bottom cementing plug 114 lands on upper end 44 of packer apparatus 42, the flow of cement in casing 20 will cause the rupturable diaphragm to burst so that cement will flow through packer apparatus 42 and float apparatus 48. As shown in FIG. 3, the flow of cement will urge valve poppet 96 downwardly to move check valve 92 to an open position so that cement will flow through check valve 92. The cement will flow out of casing 20 into annulus 36. Once a desired amount of cement has been displaced into casing 20, a top cementing plug 118 is placed in the casing behind a trailing edge 120 of the cement. Once the flow of cement has stopped, check valve 92 will move to its closed position preventing backflow of cement into the casing 20.

As is apparent from the drawings, because packer apparatus 42 has an uninterrupted bore 69, full bore unrestricted flow through packer apparatus 42 is achievable. A sufficient volume of cement for primary cementing operations is therefore available with apparatus 38 of the present invention. Typical packers known in the art have valves or other mechanisms so that a sufficient volume of cement flow for cementing casing in a wellbore is not attainable. For example, Halliburton's EZ Drill® squeeze packer has a valve configuration therein such that while the packer is adequate for use in squeeze cementing, it should not be utilized for primary cementing purposes since the necessary volume and rate of cement flow for primary cementing cannot be achieved.

Once top cementing plug 118 has landed, pressure in the well can be bled off and monitored for a relatively short period of time, for example five minutes. Equipment at the surface, such as plug containers, can then be removed and other steps taken to reassemble the wellhead at the surface. This is a great improvement over the prior art methods of drilling with casing which require a several-hour waiting period before the wellhead can be reassembled.

The foregoing descriptions of specific embodiments of the present invention have been presented for purposes of illustration and description, they are not intended to be exhaustive or to limit the invention to the precise forms disclosed but obviously many modifications and variations are possible in light of the above teaching. The embodiments were chosen and described in order to best explain the principles of the invention and its practical application, and thereby enable others skilled in the art to best utilize the invention and various embodiments with various modifications that are suited to the particular use contemplated. It is intended that the scope of the invention be defined by the claims appended hereto and their equivalents.

What is claimed is:

1. A method of cementing a casing in a wellbore comprising the steps of:

providing the casing with a drill bit on an end thereof;

drilling the wellbore with the drill bit attached to the casing;

disconnecting the drill bit from the casing when the wellbore has been drilled to a desired depth without removing the casing from the wellbore;

connecting a float apparatus to a packer assembly, wherein the packer assembly has a flow passage defined therethrough;

lowering the packer assembly and float apparatus into the casing;

setting the packer assembly in the casing so that the packer assembly engages and seals against the casing; and flowing cement through the flow passage in the packer assembly and the float apparatus so that the cement moves into an annulus between the casing and the wellbore.

2. The method of claim 1, wherein the packer assembly is lowered in the casing on a wireline.

3. The method of claim 1 further comprising the steps of:

placing a bottom cementing plug in the casing ahead of a leading edge of the cement; and placing a top cementing plug in the casing behind a trailing edge of the cement.

4. The method of claim 1, further comprising the step of drilling out the packer assembly and the float apparatus after the cement has hardened in the annulus between the casing and the wellbore.

5. A method of cementing a casing in a wellbore comprising the steps of:

drilling the wellbore with a drill bit attached to the casing;

lowering the casing in the wellbore;

disconnecting the drill bit from the casing;

connecting a check valve to a packer apparatus;

placing the check valve and packer apparatus in the casing after the drill bit is disconnected from the casing;

actuating the packer apparatus to engage the casing so that the packer apparatus holds the check valve in the casing; and flowing cement downwardly through the casing, packer apparatus and check valve so that the cement passes into an annulus between the casing and the wellbore, wherein the check valve prevents backflow of cement into the casing through the check valve.

6. The method of claim 5 where the step of placing comprises the step of placing a float apparatus in the casing, and the float apparatus comprises the check valve connected in an outer sleeve.

7. The method of claim 6 wherein the float apparatus is a float shoe.

8. The method of claim 5 further comprising the steps of:

placing a bottom cementing plug in the casing ahead of a leading edge of the cement; and placing a top cementing plug in the casing behind a trailing edge of the cement.

9. An apparatus for cementing a casing in a wellbore, comprising:

a packer apparatus disposed in the casing, wherein the packer apparatus comprises:

a packer mandrel defining a flow passage therethrough; and a packer element assembly disposed about the packer mandrel, wherein the packer element assembly is movable from an unset position in which the packer element assembly and the casing define a space therebetween, to a set position in which the packer element assembly engages the casing;

a check valve connected to a lower end of the packer apparatus, wherein cement may be displaced downwardly through the packer mandrel and the check valve to cement the casing in the wellbore, and the check valve will prevent backflow of the cement into the casing through the packer apparatus; and a drill bit connected to the casing for drilling the wellbore, wherein the drill bit is disconnected from the casing before the packer apparatus is disposed in the casing.

10. The apparatus of claim 9 wherein the check valve is connected in an outer case, and the outer case is connected to the lower end of the packer apparatus.

11. The apparatus of claim 9 further comprising a float apparatus connected to the lower end of the packer apparatus, wherein the float apparatus comprises an outer case and the check valve, the check valve being connected to the outer case.

12. The apparatus of claim 11 wherein the float apparatus is a float shoe.

13. The apparatus of claim 9 further comprising:

a threaded coupling connected to the lower end of the packer apparatus; and an outer case connected to the threaded coupling, wherein the check valve is disposed in the outer case.

14. The apparatus of claim 9 wherein the flow passage in the packer mandrel permits full bore unrestricted flow of cement therethrough to the check valve.

15. An apparatus for cementing a casing in a wellbore, comprising:

the casing;

a drill bit attached to the casing, wherein the drill bit is detached from the casing after the wellbore is drilled to a desired depth;

a settable packer assembly, wherein the packer assembly is disposed in the casing after the drill bit is detached from the casing, and the packer assembly defines a flow passage therethrough; and a check valve connected to the packer assembly wherein the check valve allows downward flow of cement and prevents backflow of cement past the check valve into the casing.

16. The apparatus of claim 15 wherein the packer assembly comprises:

a packer mandrel, wherein the packer mandrel defines the flow passage; and a packer element for engaging the casing and holding the packer assembly and the check valve in place in the casing.

17. The apparatus of claim 15 wherein the packer assembly provides for full bore unrestricted flow therethrough from an upper end thereof to a lower end thereof.

18. The apparatus of claim 15 further comprising a threaded coupling connected to a lower end of the packer assembly, wherein the check valve is connected to the threaded coupling.

19. The apparatus of claim 18 further comprising a float apparatus connected to the threaded coupling, wherein the float apparatus comprises an outer case and the check valve connected in the outer case.

20. The apparatus of claim 19 wherein the float apparatus is a float shoe.

* * * * *